United States Patent [19]

Fletcher et al.

[11] 4,072,103

[45] Feb. 7, 1978

[54] GRAVURE PRESS FOR MAKING MULTICOLOR PROOFS

[75] Inventors: C. Hugh Fletcher, Rolling Meadows; Raymond G. Bogdan, Glenview; Robert W. Wright, Des Plaines; Robert M. Cheuvront, Maywood, all of Ill.

[73] Assignee: Vandersons Corporation, Chicago, Ill.

[21] Appl. No.: 735,264

[22] Filed: Oct. 26, 1976

[51] Int. Cl.[2] ..... B41F 3/36; B41F 3/38; B41F 3/28

[52] U.S. Cl. ..... 101/151; 101/158; 101/167; 101/425

[58] Field of Search ..... 101/150, 151, 152, 158, 101/159, 160, 161, 162, 163, 164, 165, 166, 167, 155, 186, 187, 202, 210, 269, 425

[56] References Cited

U.S. PATENT DOCUMENTS

| | | | |
|---|---|---|---|
| 951,489 | 3/1910 | Saxton | 101/425 |
| 1,378,278 | 5/1921 | Roberts | 101/423 |
| 1,700,453 | 1/1929 | Schultz | 101/425 |
| 1,700,518 | 1/1929 | Schultz | 101/425 |
| 2,043,056 | 6/1936 | Mueller | 101/269 |
| 2,246,729 | 6/1941 | Gutberlet | 101/163 |
| 3,120,805 | 2/1964 | Simon | 101/425 |
| 3,413,918 | 12/1968 | Gingras | 101/158 |

FOREIGN PATENT DOCUMENTS

| | | | |
|---|---|---|---|
| 548,280 | 8/1930 | Germany | 101/167 |

*Primary Examiner*—J. Reed Fisher
*Attorney, Agent, or Firm*—Neuman, Williams, Anderson & Olson

[57] ABSTRACT

A hand fed gravure press primarily for use in making multicolor proofs. A carriage assembly for moving relative to the press bed and comprising an impression cylinder for holding the paper, an ink distribution system for consistently applying a selectable quantity of ink at a predetermined location, a doctor blade spaced a distance from the ink system for spreading the ink across a printing plate and a cleaning unit for removing excess or dried ink from the plate after printing is completed. A control system for regulating the movement of the carriage assembly and the operation of the ink distribution system, the doctor blade and the cleaning unit. The ink distribution system comprising a plurality of reservoirs for separately storing a different color ink, a plurality of channeled cylinders each connected to a respective reservoir for receiving and temporarily retaining a selectable quantity of ink and a plurality of actuators each connected to a corresponding channeled cylinder for dispensing the temporarily retained ink onto the printing plate at a predetermined location. The cleaning unit comprises an applicator for spraying solvent on the surface of the printing plate, two oppositely rotating spaced apart brush elements for sweeping the sprayed printing plate, and a vacuum apparatus disposed between the brush elements for removing any foreign matter upon the printing plate.

5 Claims, 7 Drawing Figures

GRAVURE PRESS FOR MAKING MULTICOLOR PROOFS

BACKGROUND OF THE INVENTION

The present invention is an improved gravure press for use in making multicolor proofs. The plate and paper registration are manual while the printing functions including cleaning the plate are automatically regulated. The improved gravure press includes a controlled ink distribution system and a cleaning unit for washing the plate after printing is completed.

The gravure system for printing is well-known in the art. The primary characteristic of the gravure method of printing is the clarity and sharpness of the reproduction. For this reason, the gravure method is used in the printing of multicolor material particularly when a pictorial illustration or design representation is present. Before the plates used to produce a multicolor copy are placed on a production type of press for large volume, it is common practice to generate several proof sheets of the copy. The proof sheets are examined for errors and artistic layout so that any errors or inconsistencies in the plates may be removed before a large quantity of inaccurate material is produced and unnecessary expense incurred.

Gravure multicolor proof presses are designed for low quantity production. The previously known gravure proof presses are predominantly hand operated. In the operation of known gravure flat bed proof presses, the operator will manually register the printing plate and align the paper on an impression cylinder. The first color of ink is applied by hand, commonly from a plastic deformable container, across one edge of the plate. A doctor blade is then manually used to spread the ink across the plate. The ink theoretically settles only in the wells or grooves below the planar surface of the printing plate. The impression or printing cylinder containing the paper is then moved by hand across the inked plate to obtain a copy with the first color of ink.

It is common to produce several sheets of copy in the same color ink before the plate is changed to repeat the printing operation with a different printing plate and a different color ink. However, the printing plate must be thoroughly cleaned before producing another proof sheet of the same color. The cleaning operation is critical and essential for the removal of all excess or dried ink, particularly within the wells or grooves in the plate. If the plate is not cleaned or if it is improperly cleaned, subsequent proof sheets will contain inconsistencies especially in plate well areas where dried ink remains and the new ink is precluded from properly settling. The plate well areas in which the new ink does not settle do not produce an image on a subsequently pulled proof sheet. The cleaning operation is a manual procedure which includes the hand scrubbing of the plate on the press bed and the subsequent removal of the cleaning solution and diluted ink. It should be apparent that while described for a flat bed press, similar operations are necessary for a rotogravure press. Of course, the cleaning operation is repeated after the printing of each proof sheet for each color of ink needed. It is common for the completed proof to use four different colors of ink and correspondingly require four different printing plates, but it should be appreciated that any number of ink colors and plates more or less than four can be used following the same procedure.

There are numerous disadvantages of the known gravure proof presses. The time involved in the manual printing operation and clean up is extensive and the consequent cost of the finished proof is exorbitant. However, more important than the practical considerations of time and expense, the known gravure proof presses neither provide high quality proofs nor consistently uniform quality proofs. These latter disadvantages stem from the predominantly manual operation and its lack of uniform repeatability.

A major difficulty of manual operation is the application of ink to the print plate. Since the operator manually applies the ink, the quantity of ink necessarily varies for each application and the location of the placement of the ink changes. Since ink, especially printing ink, is quick drying in air, the quantity of ink applied, usually in an elongated bead along one edge of the plate, affects the ink's drying time parameter. Furthermore, the time lapse between ink application and manually spreading the ink with the doctor blade varies substantially between different applications. Consequently the degree of drying of the ink at the moment of doctor blade spreading is different and this affects the ink's spreadability characteristic. This time interval is erratic in manual operation and the uniformity and repeatability of the application and spreading process are uncontrollable.

Another problem area involves the pressure applied to the doctor blade during the spreading of the ink. Since the operation is manual, the applied pressure fluctuates between successive operations. This results in uneven settling of the ink into the print plate wells or noncomplete removal of excess ink from the plate surface. These circumstances result in streaks of ink on the proof sheet or a variable density of the reproduced lines on the proof sheet.

Yet another difficulty in known gravure proof press operation is the inconsistent movement of the print cylinder across the inked plate. If the speed of movement is not uniform, the paper absorbs different amounts of ink dependent upon the length of time that the paper remains in contact with the inked plate. The amount of ink absorbed from the plate determines the sharpness of color of the produced image on the proof sheet. The manual operation renders speed of movement and hence sharpness of color unrepeatable.

A further disadvantage of known gravure presses is the manual cleaning or washing necessary after each printing step or pull. The quality of manual cleaning is variable and uncertain. In addition to being time-consuming and messy, the manual cleaning leaves dried ink or solvent on the plate. Any foreign material on the plate during the printing step appears in some undesirable manner on the proof sheet. The foreign matter results in a streak of ink if it remains on the planar surface of the print plate. If dried ink remains within the printing plate wells, a subsequent application of ink is unable to settle in the appropriate well and that uninked area does not produce an image on the pulled proof sheet. The manual cleaning of the printing plate results in poor quality proofs.

These and other disadvantages of known gravure multicolor proof printing make it a costly and time-consuming operation. In addition, the quality of the completed multicolor proof sheet is erratic and the repeatability of the process inconsistent.

SUMMARY OF THE INVENTION

The present invention overcomes the disadvantages of the known gravure proof presses and provides a proof sheet with high quality resolution and a process with consistent repeatability.

The improved gravure press is particularly useful in making multicolor proofs. A printing plate is registered on the press bed by manual adjustment and the sheet of paper is aligned on an impression cylinder by hand. A control system regulates the movement of a carriage assembly from the paper loading position at the closed end of the press across the press bed and printing plate to the open end of the press and from that position back to the closed end of the press. Both the direction of carriage movement and the speed of movement are regulated.

The carriage assembly comprises an ink distribution system, a doctor blade, an impression cylinder, and a cleaning unit. The operation and timing of these devices is directed by the control system to provide uniform and repeatable operation.

The ink distribution system comprises four ink reservoirs, each containing a different color ink if a four color proof is required. Of course, the number of ink colors and corresponding components of the inking system may be increased or decreased. Each reservoir is connected to an ink retaining device. The retaining device comprises a plurality of rotatable cylinders each with an ink receiving cell or channel extending the longitudinal length of the cylinder and a slotted housing for holding the cylinders. Air pressure is applied from the control system to each reservoir, and upon operator selection of the ink color and corresponding reservoir at a panel of the control system, a predetermined quantity of ink is transferred from the reservoir to a receiving cell in a corresponding cylinder. Since the volume of the receiving cell is predetermined and variable, a selectable quantity of ink is transferred under pressure from the reservoir. Each cylinder is connected to an actuator for rotating the cylinder about its longitudinal axis. As the carriage assembly moves along the length of the press bed toward the open end, the control system energizes the actuator corresponding to the filled retaining cylinder causing the cylinder to rotate and discharge the ink from the receiving cell through a corresponding slot of the housing. In this manner, the ink is applied to the plate at a predetermined location.

Spaced at a desired interval behind the ink distribution system is a spreading device or doctor blade for uniformly spreading the measured quantity of ink across the printing plate. When the carriage assembly is moving forward during the print operation, the doctor blade is applied against the plate at a selectable pressure under direction of the control system.

The impression cylinder holding the sheet of paper is moved across the printing plate after the doctor blade spreads the dispensed ink to complete a single printing operation or stroke. The speed of the carriage assembly and, correspondingly the time interval that the paper remains in contact with the inked plate, is variable and directed by the control system.

Therefore, all of the variable parameters of the printing operation present in earlier gravure proof printing systems have been eliminated. In the improved gravure press, the quantity of ink is controlled as is its placement location; the time interval between ink application and doctor blade contact with the ink, as well as blade pressure is regulated; and, the speed of carriage movement and consequently the duration of paper contact to the plate is controlled.

After the printing stroke is complete and the paper removed from the impression cylinder, the control system removes the pressure against the doctor blade, moving it out of an engagement position with the press bed and simultaneously positions the cleaning unit for operation. On the return stroke of the carriage assembly to complete the printing cycle, the cleaning unit removes any dried ink or foreign particles on the printing plate.

The cleaning unit comprises a solvent applicator which discharges a liquid solvent over the plate area, two oppositely rotating brushes for loosening dried ink within the printing plate wells, and a vacuum apparatus with a port located between the brushes for removing the excess solvent and ink. The brushes rotate in opposing directions to propel the foreign matter towards the vacuum port. After the cleaning unit thoroughly and uniformly cleans the plate and all foreign matter is removed by the vacuum, the print cycle is completed. The gravure press is now ready to repeat the entire cycle. Thus, the inconsistent cleaning occasioned by the manual process is eliminated.

An object of the present invention is to provide a gravure press for making multicolor proofs having a high degree of line resolution.

Another object is to provide a gravure multicolor proof press for repetitively making proofs of uniform quality.

Another object is to provide a gravure press with an ink distribution system for automatically controlling the quantity of ink applied to the printing plate.

A further object is to provide a gravure press with a variable pressure controlled doctor blade and a substantially regulated time interval between ink application and doctor blade spreading of the ink.

A still further object is to provide a gravure press in which the direction and speed of movement of the impression cylinder is controlled.

A still further object is to provide a gravure press with an automatic cleaning unit to remove unwanted dried ink and foreign matter from the print plate.

Still additional objects and advantages of the present invention will become apparent from a reading of the detailed description of the drawings in which.

DETAILED DESCRIPTION

Figure 1:
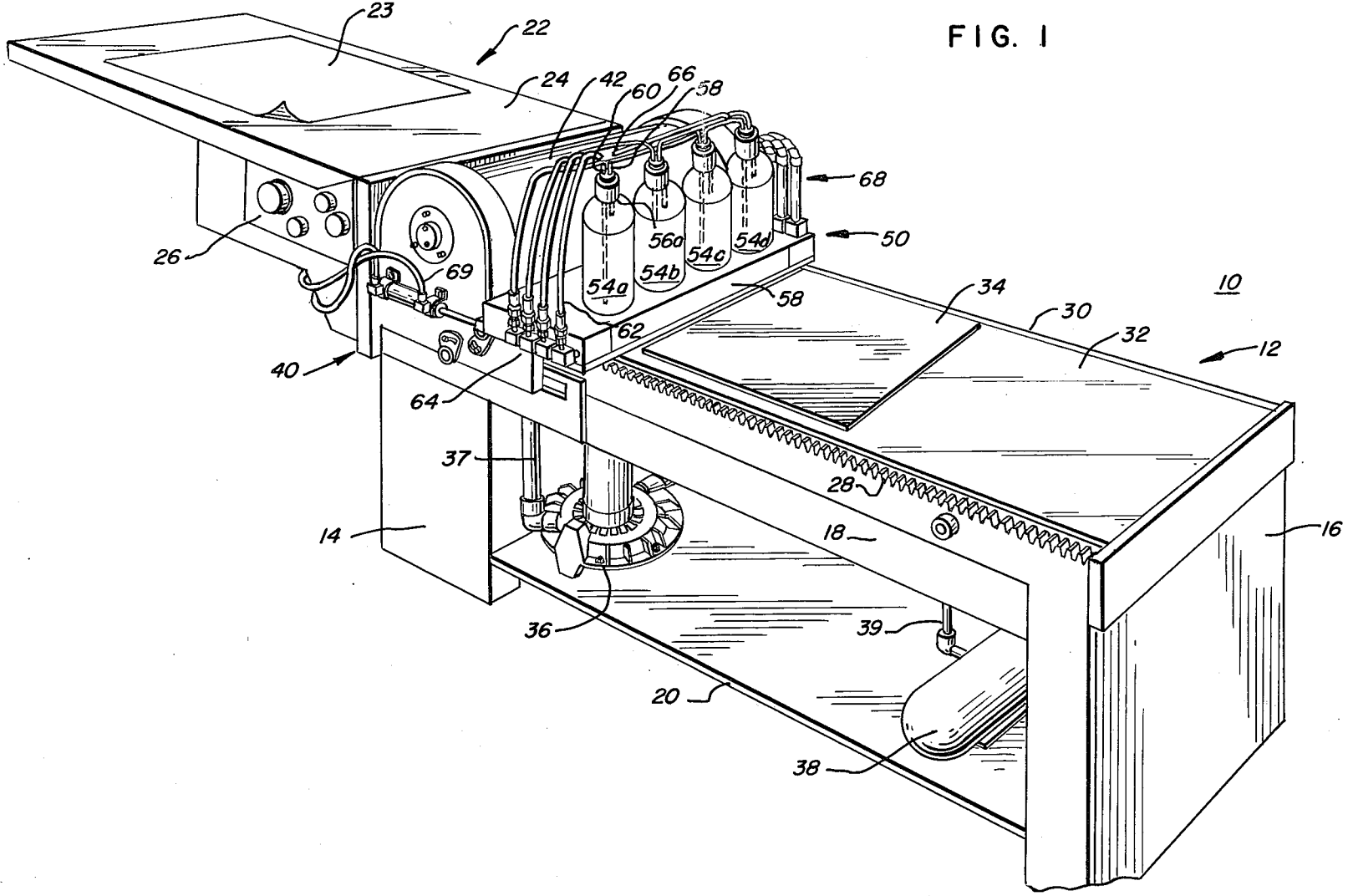
FIG. 1 is a perspective view of the improved gravure press.
Figure 6:
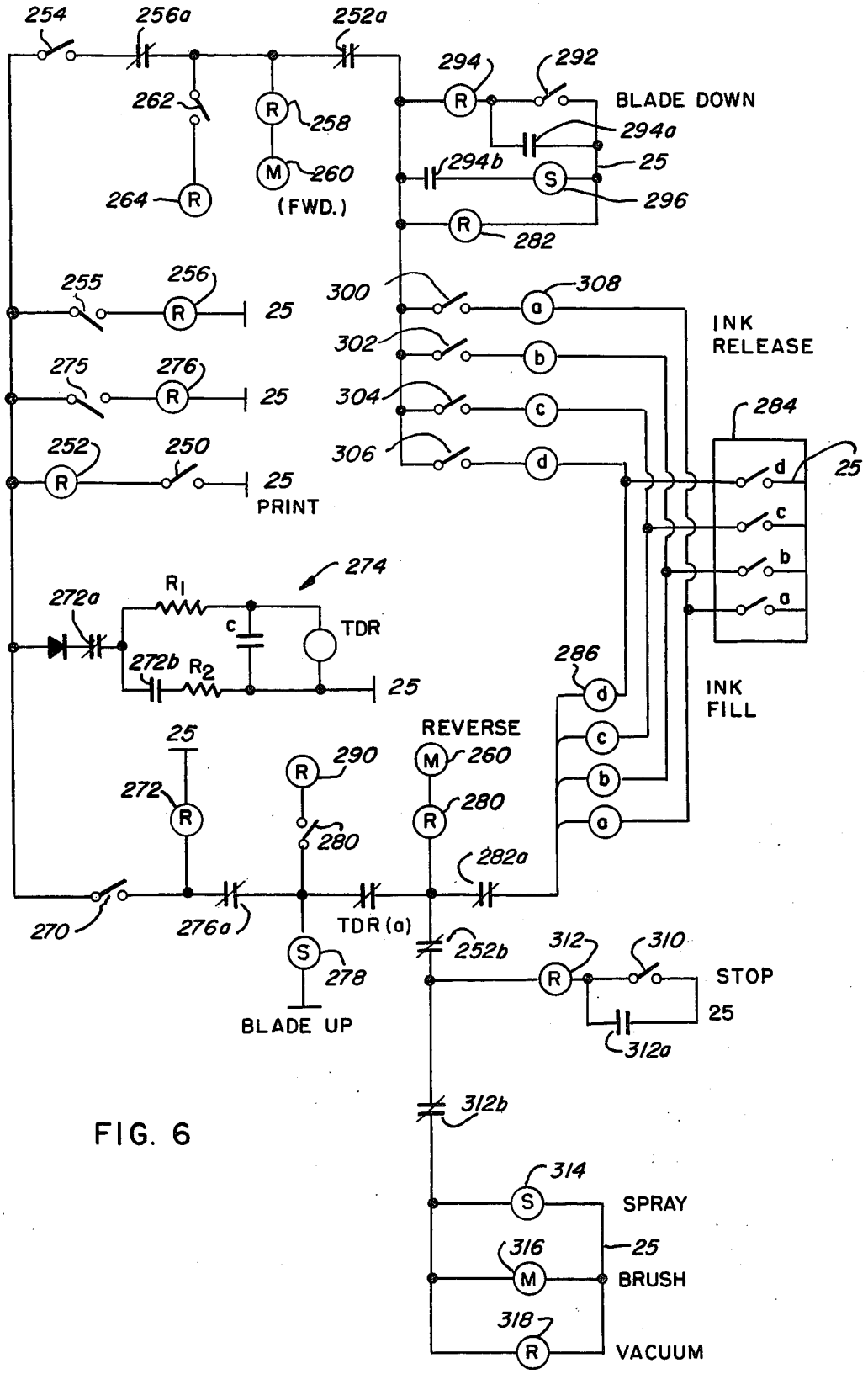
FIG. 6 is a schematic and block diagram of the electrical control system.
Figure 7:
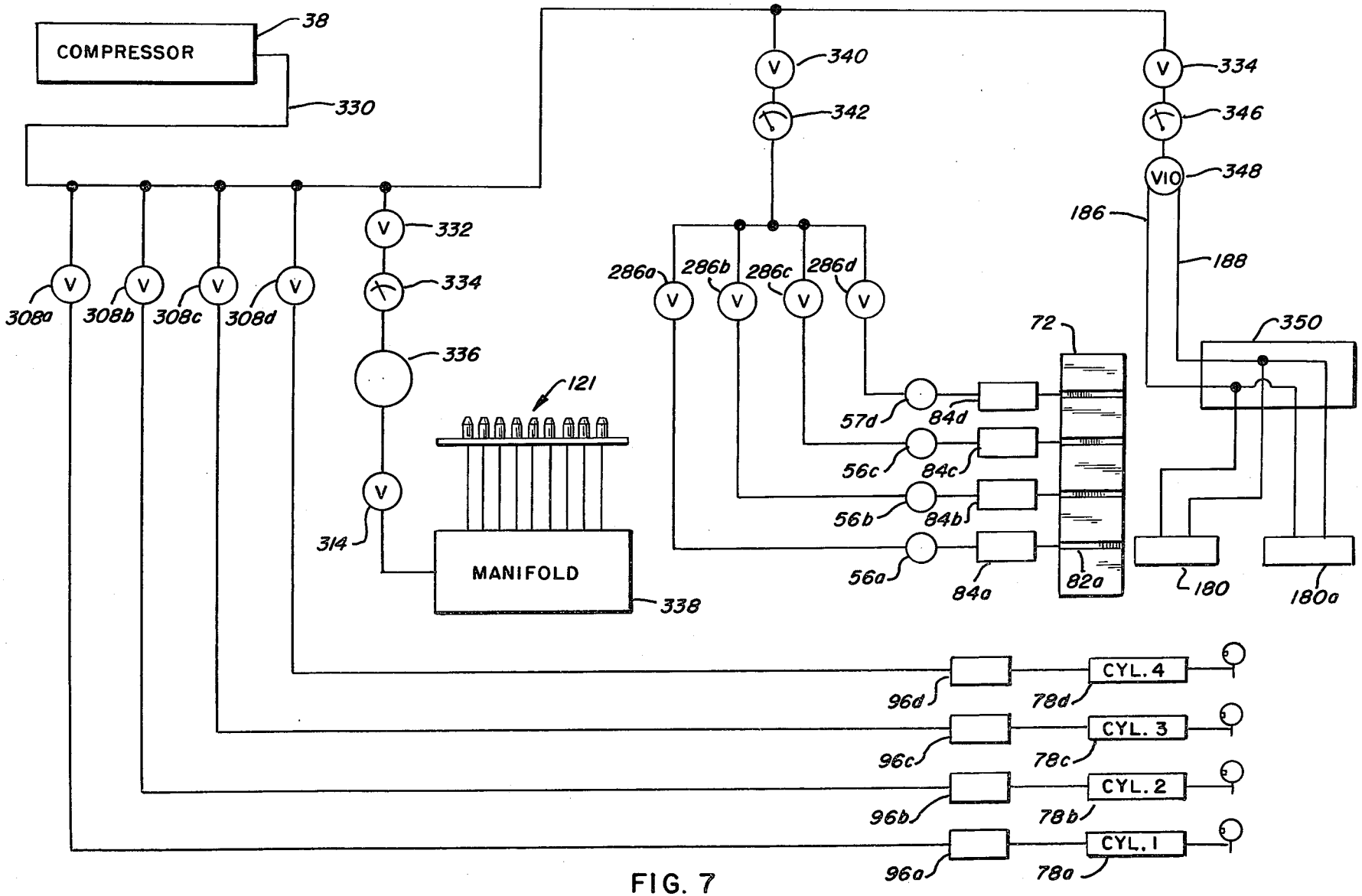
FIG. 7 is a diagram of the air pressure lines of the control system.

FIG. 1 is a perspective view of the improved gravure press 10. The frame 12 of the press comprises two leg supports 14 and 16 and the horizontal body 18. Connected between leg supports 14 and 16 and subtending body 18 is a shelf 20 for holding various components. At the front or closed end of the press 10 a loading unit 22 is secured by any well-known means to the frame 12. A sheet of paper 23 is spread upon the horizontal top surface or feed board portion 24 of the unit 22 during the paper loading operation. The panel 26 of the control system for regulating the operation of the press, shown in FIGS. 6 and 7, is mounted at the side of unit 22.

At the closed end of the press 10 adjacent the loading unit 22 is the carriage assembly 40. The carriage assembly 40 is positioned for movement on a pair of spaced parallel rails 28 and 30 which extend along the side of body 18 from the closed end to the open end of the press 10. The carriage assembly 40 is driven by a motor, not shown, along the rails 28 and 30 across the top surface or bed 32 of the body 18. Positioned on the bed 32 is a gravure printing plate 34. The relative position of the plate 34 may be adjusted in both the horizontal and vertical directions by means well-known in the art. A vacuum unit 36 and an air compressor 38 are placed on shelf 20 and connected through tubes 37 and 39, respectively, to the control system, as described hereinafter.

A print or impression cylinder 42 forms a portion of the carriage assembly 40. The sheet of paper 23 to be printed is placed on feed board 24 and one edge of the paper is attached to the print cylinder 42 and aligned for proper positioning by calipers and other well-known means. During the forward movement of the carriage assembly 40 towards the open end of the press, the print cylinder 42 will rotate and wrap the sheet of paper around the circumference of the cylinder 42. If printing is to take place, the print cylinder 42 is positioned to force the paper against the plate 34, however, if printing is not desired, the cylinder 42 is not brought into contact with the press bed 32. The print position and blank or nonprint position of the impression cylinder 42 are standard and well-known in the art and not described further.

An ink distribution system 50 forms a portion of the carriage assembly 40. The ink distribution system is shown in greater detail in FIGS. 2 and 3. A slotted block or housing 52 operates as a base support for inking system 50. Four reservoirs 54*a*, 54*b*, 54*c*, and 54*d* are spaced across the top surface of block 52 and secured thereto by any standard means such as brackets, not shown. Each reservoir contains a different color ink for use in printing such as yellow, red, blue, and black. It should be appreciated that the number of reservoirs could be increased or decreased with a corresponding modification in the remainder of the ink distribution system 50. In a like manner, the different color inks contained within the reservoirs may be altered to obtain any desired result.

Each reservoir 54*a*, 54*b*, 54*c*, and 54*d* has a receiving cap 56*a*, 56*b*, 56*c*, and 56*d* which are identical in structure so that only a single cap will be described in detail. Receiving cap 56*a* has two openings or ports. A pressure conduit 58 extends through cap 56*a* beginning slightly above the exterior surface and terminating within the reservoir 54*a*, but above the level of the contained ink. An ink extraction conduit 60 extends through the second port of cap 56*a*. The ink extraction conduit 60 begins slightly above the surface of cap 56*a* and terminates close to the bottom of the reservoir 54*a* below the level of the contained ink. An air pressure hose 62 is connected to the extraction conduit 60 and to an ink transfer mechanism 64, more fully described hereinafter. Hose 66 is connected to pressure conduit 58 and to air compressor 38 and supplies air pressure to reservoir 54*a* under command of the control system. When the reservoir 54*a* is placed under air pressure, ink transfers via extraction conduit 60, hose 62 through transfer mechanism 64 to the remainder of the ink distribution system 50 for temporary storage. Positioned at the opposite side of the block 52 are the inking actuators 68 which are pressure operated under command from the control system to apply the ink from temporary storage at a predetermined time during the carriage assembly movement as described hereinafter.

Figure 4:
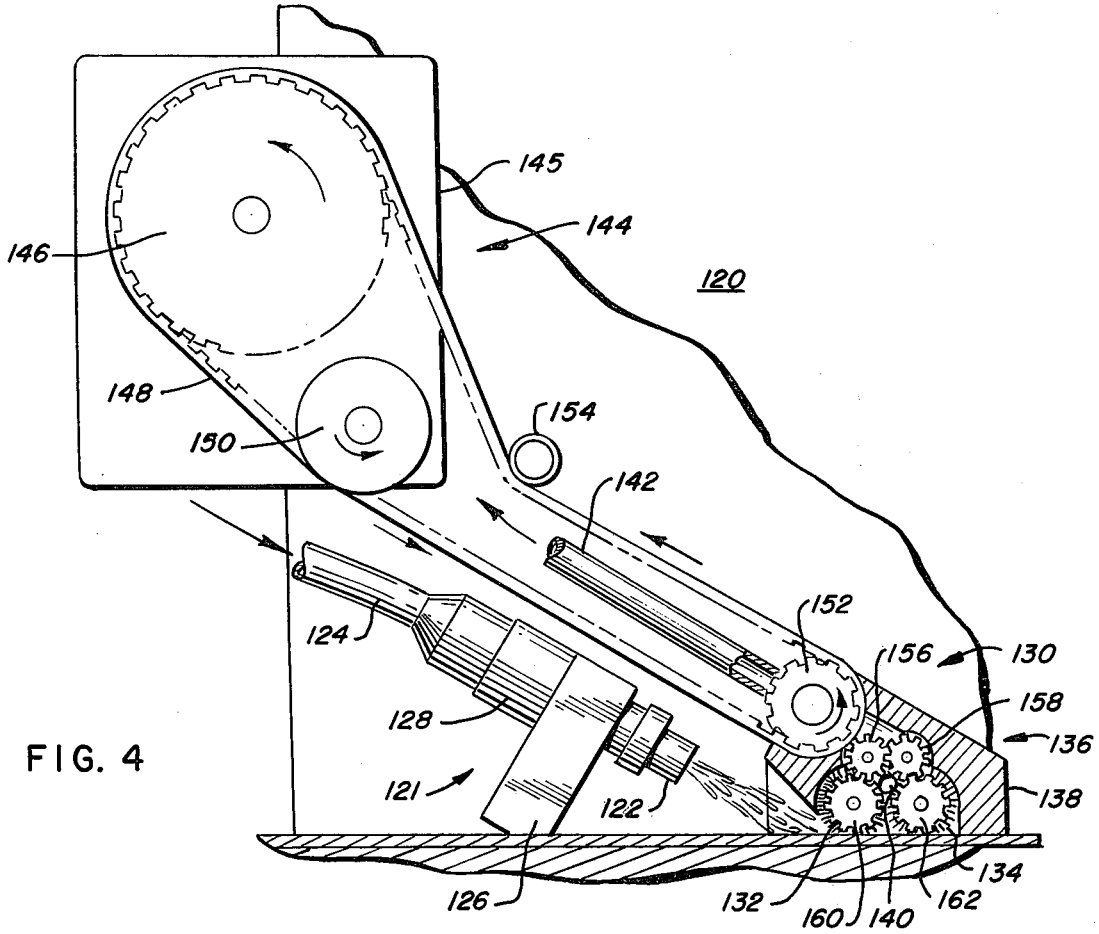
FIG. 4 is an illustration of the cleaning unit of the gravure press.
Figure 5:
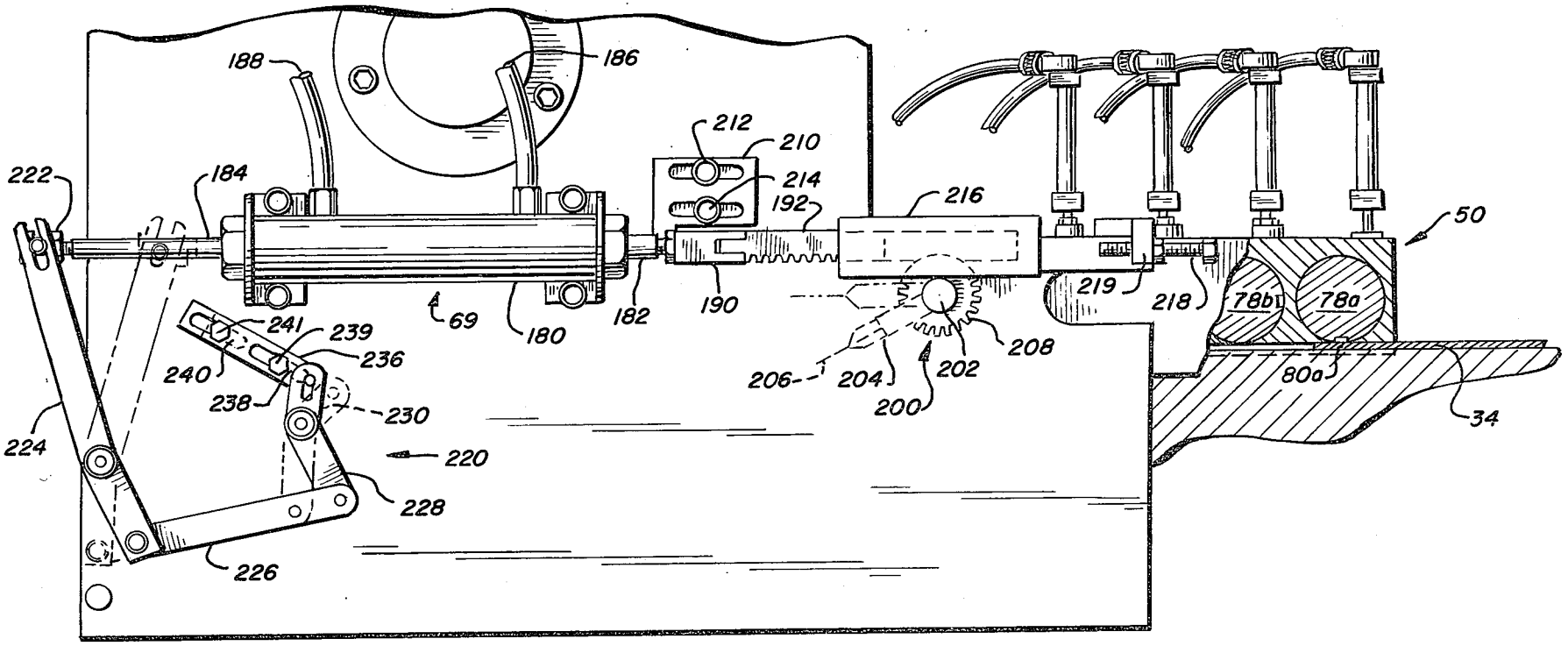
FIG. 5 is a side view of the gravure press.

The cleaning unit 120, illustrated in FIG. 4, is also mounted upon the carriage assembly 40 for cleaning the inked plate 34 after the printing operation is completed and during the return travel of the carriage assembly 40. The cleaning unit 120 is positioned after the impression cylinder 42 in the carriage assembly 40 or closer to the loading unit 22. In addition, a doctor blade 200, illustrated in FIG. 5, is mounted on the carriage assembly 40 between the ink distribution system 50 and the print cylinder 42. The doctor blade 200 is controlled in movement by two-position cylinder structure 69 between a down position for contacting the dispensed ink and for spreading it across the surface of the plate 34 and an up position out of contact with the plate 34 for return travel of the carriage assembly 40. The cylinder structure 69 also moves the cleaning unit 120 in a complementary fashion to the doctor blade 200 so that during the forward movement of the carriage assembly 40 when the doctor blade is in the down position the cleaning unit 120 is in the up, or inoperative, position; similarly during the return, or reverse, movement of the carriage assembly 40 when the doctor blade 200 is in the up position, the cleaning unit 120 is in the down, or operative position. It should be apparent that the air hose connections to the various components described above and hereinafter are of a sufficient length to allow complete movement of the carriage assembly 40 from the closed end to the open end of the press 10.

Figure 2:
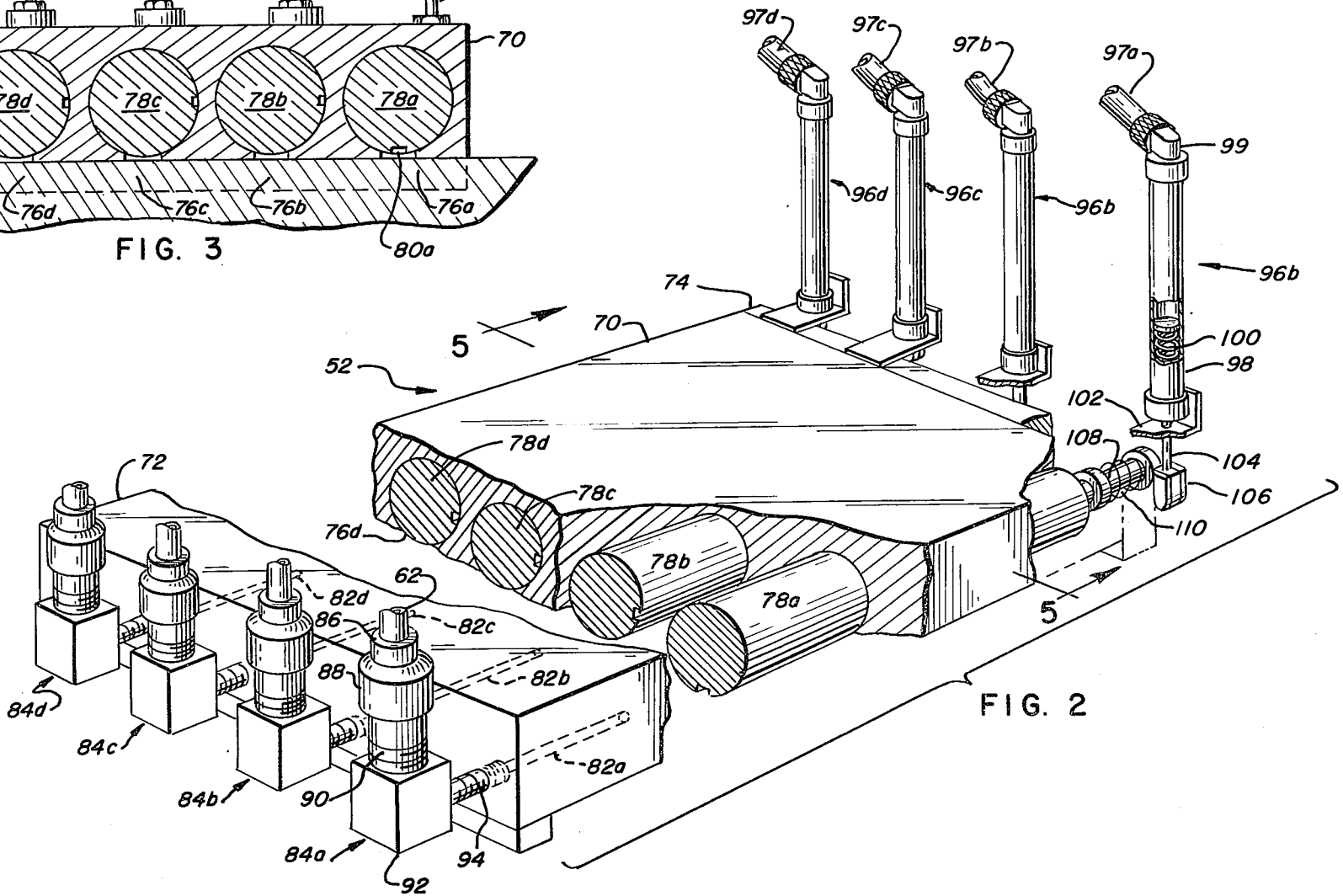
FIG. 2 is a partially cut away view of the ink distribution system of the gravure press.

FIG. 2 is a cut away view of the ink distribution 50 without the reservoirs 54*a*, 54*b*, 54*c*, and 54*d* and associated structure. The slotted block 52 is a substantially rectangular body 70 with corresponding face plates 72 and 74 secured at each longitudinal end. A plurality of spaced cylindrical hollows extend the length of the body 70 and are oriented so that the interior surface of the body 70 forms the contiguous walls of the hollows, except for a small arc at the bottom of the body 70. Each small arc forms an open elongated slot 76*a*, 76*b*, 76*c*, and 76*d* extending the length of the body 70 corresponding to each hollow cylindrical opening, refer to FIG. 3.

The plurality of cylindrical shafts 78*a*, 78*b*, 78*c*, and 78*d* each with recessed groove 80*a*, 80*b*, 80*c*, and 80*d* extending its longitudinal length, fit into a corresponding hollow of the body 70 and are adapted for rotational movement. Each cylindrical shaft 78*a* through 78*d* retains ink from the corresponding reservoir 56*a* through 56*d* in its recessed groove or receiving cell 80*a* through 80*d*.

A plurality of apertures or fluid conduits 82*a*, 82*b*, 82*c*, and 82*d* extend through the face plate 72. Each aperture 82*a* through 82*d* connects to one of the individual transfer devices 84*a* through 84*d* of the ink transfer mechanism 64. The structure of the transfer devices 84*a* through 84*d* are identical and for the sake of simplification of the drawing, only transfer device 84*a* will be described in detail. Transfer device 84*a* receives the hose 62 from a corresponding reservoir of ink 56*a* via collar 86, sleeve 88, extended nipple 90, block 92, and valve port 94. Ink is transferred from the reservoir 56*a* through the transfer device 84*a* and fluid conduit 82*a* to receiving cell 80*a* when air pressure is applied to reservoir 56*a*, as described with reference to FIG. 1. At the opposite end of the cylinder 78*a* an air bleeder aperture and valve, not shown, as is well-known in the art, extends through rear plate 74 so that as the ink is supplied from reservoir 56*a* to cell 80*a*, the air previously in cell 80*a* is released.

The opposite end of each retaining cylinder 78*a* through 78*d* is connected through back plate 74 to an actuator system 68 comprising individual actuators 96*a* through 96*d*. Each actuator 96*a* through 96*d* is connected to a corresponding cylinder 78*a* through 78*d* and is respectively operated by air pressure supplied by hose 97*a* through 97*d* under direction of the control system. The structure of each actuator 96*a* through 96*d* is identical, and for the sake of simplification of the drawing, only actuator 96*a* will be described in detail. Actuator 96*a* compresses a valve 98 and internal return spring 100. Actuator 96*a* is mounted on the back plate 74 by a bracket 102 or any similar means. In the normal or quiescent position, actuator 96*a* allows spring 100 to retain the arm 104 in an upward position and correspondingly the associated cell 80*a* of the retaining cylinder 78*a* is generally horizontal. The cell or groove 80*a* in the cylinder 78*a* together with the internal side walls of the hollow in housing body 70 form a container for temporarily retaining the ink. The ink within the cell 80*a* is a predetermined quantity received under pressure from reservoir 56*a*. The quantity of ink can be varied by altering the volume of the cell 80*a* by inserting shims or other material not shown. As an alternative, the volume of ink can be altered by adding a timing circuit to restrict the duration of ink flow from a reservoir to a corresponding cylinder. Since the pressure and conduit shapes are known modifying the time of ink flow proportionally changes the quantity of ink supplied to a cylinder.

Hose 97*a* is connected through fitting 99 to the valve 98 for controlling its state of operation. Plunger or arm 104 of valve 98*a* is connected to clevis 106. Clevis 106 is connected to finger shaft 108 and shaft 108 is connected through back plate 74 to the terminal end of the retaining cylinder 78*a*. The cylinder 98 is energized by air pressure from the control system, and plunger 104 is forced downward causing clevis 106 to move in sympathy and rotate shaft 108 in the clockwise direction. The rotation of the shaft 108 forces the retaining cylinder 78*a* to rotate 90° so that the cell 80*a* is disposed from the normal horizontal to the dispensing vertical position, as illustrated.

Figure 3:
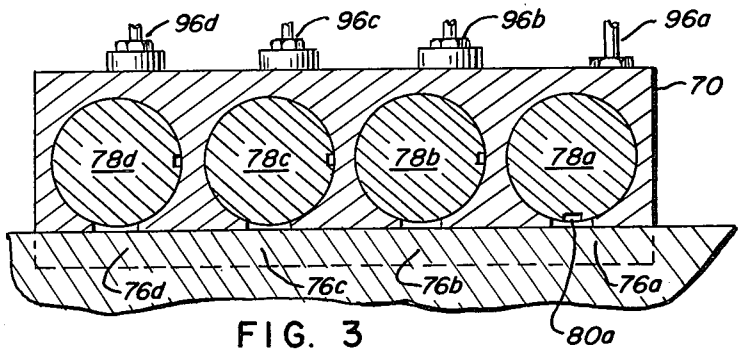
FIG. 3 is a cross-section taken along line 5—5 of FIG. 2 showing the ink distribution system.

FIG. 3 is a cross-section along line 5—5 of FIG. 2, cell 80*a* aligns with the slot 76*a* in the body 70 and the ink within cell 80*a* is applied through channel 76*a* in the body 70 to the plate 34 (not shown). In this manner, the predetermined quantity of ink forced under pressure into cell 80*a* and temporarily maintained therein without deterious contact to the atmosphere is precisely and uniformly applied to the plate surface. After a sufficient time interval to dispense the ink, the valve is de-energized and returns to its normal position under the influence of internal spring 100 and assist spring 110. The retaining cylinder 78*a* rotates counterclockwise to its normal position with cell 80*a* in the horizontal position.

FIG. 4 illustrates the cleaning unit 120. Cleaning unit 120 is mounted on the carriage assembly 40 adjacent to the print or impression cylinder 42 and operates on the return stroke of the carriage assembly 40 to remove the used and dried ink from the plate 34.

A solvent applicator 121 is positioned to spray a solution such as benzene from a nozzle 122 on to the plate 34. The applicator 121 receives the solvent from a container, not shown, through hose 124 under direction of the control system. The nozzle 122 is positioned at a slight angle, such as 30° from the horizontal, by mounting block 126. The solvent from hose 124 is applied through applicator housing 128 including a screen, not shown, to filter out unwanted particles to the nozzel 122. In the preferred embodiment, there are nine solvent applicators 121 spaced apart and transverse to the plate 34. It should be noted that the number of applicators can be altered without affecting the principal of operation. Each applicator 121 is mounted on the frame of cleaning unit 120 in a well-known manner.

Removal apparatus 130 is mounted on the frame of cleaning unit 120 and spaced to the front of solvent applicator 121 or closer to the impression cylinder 42, not shown. The removal apparatus 130 comprises two oppositely rotating brush elements 132 and 134 and vacuum unit 136. The vacuum unit 136 includes housing 138, vacuum port 140 positioned between brush elements 132 and 134 and hose 142 connected to vaccum unit 36 through tube 37 of FIG. 1. The residue from vacuum unit 36 is discharged from the work area via discharge pipe, not shown.

The brush elements 132 and 134 are mounted on shafts, not shown, and extend the transverse width of the press bed 32. The vacuum housing 138 and port 140 are co-extensive with the brush elements. The brush elements 132 and 134 are driven in opposite rotation by the gear and pulley assembly 144. A motor 145, energized by the control system, drives cog gear 146 counterclockwise. Timing belt 148 connected to cog gear 146 causes idler gear 150 and pinion 152 to rotate counterclockwise. Wheel 154 provides tension for the belt 142.

First intermediate gear 156 engages pinion 152 and rotates clockwise. Second intermediate gear 158 engages first intermediate gear 156 and rotates counterclockwise. The first intermediate gear 156 meshes with the left final brush gear 160 and the second intermediate gear 158 meshes with right final brush gear 162. The final left brush gear 160 rotates counterclockwise and final right brush gear 162 rotates clockwise. Thus, the associated brushes 132 and 134 rotate in opposing direction so that in unison the brushes 132 and 134 force any dried ink or solvent toward the vacuum port 140.

The vacuum unit 136 is enclosed within housing 138. Skirt elements, not shown, may be secured to the outer edges of the housing 138 to provide a more effective suction for the vacuum port 140. FIG. 5 is a cut away side view of the press 10 showing the operation of two-way action of cylinder structure 69 which operates the position of both the doctor blade 200 and the cleaning unit 120.

Plungers 182 and 184 of cylinder 180 are disposed at opposite ends and extend and retract in a complementary fashion. Two air hoses 186 and 188 are respectively connected for the operation of cylinder 180. If air pressure is received in the cylinder 180 through hose 186, the plunger 182 is retracted in a linear fashion and plunger 184 similarly extended. The plunger 182 is connected to a C-shaped clevis 190 which transfers the linear motion of the plunger 182 to the rack 192.

A doctor blade assembly 200 extends transverse across the press bed on shaft 202. Blade holder 204 is affixed to the shaft 202 in any well-known manner. In the preferred embodiment, the holder 204 is an adjustably slotted cylindrical assembly in which the actual doctor blade 206 can be inserted and rigidly held. In the preferred embodiment, there are four such holders appropriately spaced on the axis of the shaft 202. Furthermore, as is well-known in the art, the doctor blade 206 comprises a thin flexible sharp metal edge and a heavier gauge rigid backing strip but for the sake of clarity, doctor blade 206 is illustrated as a single line. It should be noted that the structure shown in FIG. 5 is repeated at the opposite side of press 10 to provide uniformity of operation. Gear 208 is connected to the shaft 202 and adapted to engage with the linear rack 192. As the rack 202, moves in a linear fashion it engages gear 208, the shaft 202 rotates in a counterclockwise direction causing the doctor plate 206 to be rotated downward into the printing plate contact position from the dotted line up position shown in FIG. 5. In addition, as the rack gear 192 moves toward the left, it engages stop plate 210 prohibiting further movement of rack 192.

The stop plate 210 is slotted and adjustably secured to the carriage assembly frame by fasteners 212 and 214. When the linear motion of the rack is stopped, the downward position of the doctor blade 200 is fixed. Thus, by adjusting the position of stop plate 210, the position of doctor blade 200 is controlled.

In a similar fashion, if air pressure is received by cylinder 180 via tube 188, the plunger 182 is extended and plunger 184 retracted. As plunger 182 extends, clevis 190 forces rack 192 to move in a linear manner to the right in FIG. 5. The rack 192 again engages gear 208 causing the shaft 202 to rotate clockwise forcing the doctor blade 206 to obtain the up or dotted position. Guide or limiter plate 216 moves with the rack 192 and contacts adjustable set screw 218. Set screw 218 is adjustably threaded through bracket 219 affixed to the carriage assembly frame. When guide plate 216 contacts the terminal point of screw 218, the upward motion of doctor blade 200 is stopped.

When the plunger 182 is retracted and the doctor blade 200 is in the down position, the opposite plunger 184 is extended and the linkage assembly 220 and the cleaning unit 120 which is attached to the linkage 220 raises out of contact with the bed of the press 10. Plunger 184 is connected to clevis 222. Major arm 224 of the linkage assembly 220 is fastened in a lost motion connection to clevis 222. Lever 226 is movably connected to arm 224 and to minor arm 228. Minor arm 228 is movably connected to short lever 230. Short lever 230 is movably connected to lifting bar 236 through an elongated slot. Lifting bar 236 has two elongated slots 238 and 240 which operate as caming surfaces for the bolts 239 and 241 connected to the cleaning unit for raising or lowering the unit.

When the doctor blade is in the down position, which occurs during the forward movement of the carriage assembly 40, the plunger 182 of dual action cylinder 180 is retracted and the plunger 184 is extended which through the linkage assembly 220 lifts the cleaning unit 120 out of contact with the bed of the plate. During the return stroke of the carriage assembly 40, the doctor blade is rotated out of contact with the bed of the press by the extension of plunger 182 of dual action cylinder 180. The complementary retraction of plunger 184 causes the relative motion in the linkage assembly as illustrated by the dotted line position of the various components. The lifting arm 236 will lower the cleaning unit 120 upon caming surfaces 239 and 240 into position so that the excess and dried ink and any foreign particles on the plate can be removed. The operation of the cylinder 180 is regulated by the control system.

Also illustrated in FIG. 5 is the ink distribution system 50 with a partial cut away showing the first cylinder **78*a* dispensing the ink from groove 80*a* onto the surface of the plate 34. The dispensing of the ink upon plate 34 under regulation from the control system occurs upon the forward motion of the carriage assembly 40 and slightly advanced in timing to the lowering of the doctor blade 200**.

FIG. 6 is a schematic diagram of the electrical portion of the control system. Print-trip switch 250 is controlled by the press operator from control panel 26. In the closed or trip mode of operation switch 250 permits the carriage assembly 40 to move from the closed to the open end of the press 10 and return without an energization of a majority of the functions of the press discribed hereinafter. In the open or print mode of operation switch 250 de-energizes print relay 252 with normally closed contacts **252*a* and 252*b* which activate the various functions of the press 10** that are suppressed in the trip mode of operation.

For movement of the carriage assembly 40 from the closed end to the open end of the press without operation of the printing functions, print-trip switch 250 is closed and print relay contacts **252*a* and 252*b* are correspondingly opened. The press operator closes forward direction switch 254 which supplies power across normally closed forward relay contact 256*a* to close the forward relay 258 of universal of D.C. motor 260. The motor 260 will drive the carriage assembly across the bed of the press 10 in a standard and well-known manner. Contact 252*a* is open since print relay 252 is energized and therefore, no power is supplied to the rest of the system. As the carriage assembly 40 moves across the press, a cam connected to the carriage assembly 40 contacts microswitch 262 closing uniform speed relay 264 coupled to the motor 260. The motor 260 is controlled by a variac so that the operator may adjust the carriage assembly speed 40 from the control panel 26 but when uniform speed relay 264 operates the motor is switched to a uniform speed. The microswitch 262 is positioned on the frame of the press 10 and located just past the placement of the plate 24 in the forward motion direction of the carriage assembly 40 so that the carriage assembly 40 will move at operator adjusted speed until microswitch 262 is closed which reduces to a fixed voltage the power supplied to the motor 260 and correspondingly provides the carriage assembly 40 with a uniform speed. As the carriage assembly 40 approaches the open end of the press 10 a cam on the carriage closes microswitch 255 and relay 256 energizes and opens contact 256*a* removing power to stop the motor 260 and energizes the dynamic breaking in the motor as is well-known in the art. It should be understood that microswitches 255 and 262 described above and those described hereinafter are mounted along the frame of the press 10 and as the carriage assembly 40 moves caming surfaces contact and close the microswitches. By altering the positions of the microswitches along the frame of the press 10 or the position of the cams on the carriage 40**, the time of the functions can be altered. The location of the microswitches is described and not illustrated for the sake of clarity in the drawings.

The carriage assembly 40 can be returned to the closed end of the press 10 in the trip mode or the print mode. In the trip mode, switch 250 is closed, relay 252 is energized and contacts 252*a* and 252*b* opened. The operator closes reverse switch 270 which energizes relay 272. Relay 272 opens contact 272*a* and closes contact 272*b* in the timing circuit 274. The capacitor C in timing circuit 274 is charged through resistor R1 to a voltage during the forward motion of the carriage assembly 40 when the relay contact 272*a* is closed. The relay 272 energizing closes contact 272*b* connecting resistor R2 in circuit with the capacitor C and the stored voltage on capacitor C begins to discharge. The time delay relay TDR remains energized due to the voltage stored on capacitor C. After a predetermined time the stored voltage falls below a predetermined minimum and time delay relay de-energizes closing contact TDR(*a*). As soon as reverse switch 270 closes solenoid valve 278 energizes through normally closed relay contact 276*a* and the doctor blade is moved to the up position. Thus, the doctor blade is always in the up position when the operator desires the carriage to move in the reverse direction and closes switch 270.

After the time delay relay contact TDR(*a*) closes the reverse motor relay 280 closes. The closing of relay 280 reverses the field to universal motor 260 in a well-known manner in the art causing the motor 260 to drive carriage assembly 40 toward the closed end of press 10. As the carriage 40 approaches the closed end of the press 10, a cam on the carriage 40 closes microswitch 288 which through relay 290 places a uniform voltage to motor 260 as explained above. As the carriage moves at the uniform speed, a cam on the carriage closes microswitch 275 energizing relay 276 and opening relay contact 276*a* which removes power causing the motor to stop by dynamic breaking.

If carriage assembly 40 is returned to the closed end of the press 10 with switch 250 open or in the print mode during the return travel of the carriage assembly 40, the ink will be supplied from one of the reservoirs to one of the receiving cylinders for subsequent dispersion to the plate 34. If print-trip switch 250 is open, the print relay 252 is de-energized closing contacts 252*a* and 252*b*. Before the carriage 40 begins the return stroke by the operator closing reverse switch 270, the operator selects one of four positions on selector switch 284*a* through 284*d* on the control panel 26. If the operator closes selector switch 284*a*, only solenoid 286*a* will energize and load ink from a corresponding reservoir to a retaining cell. Refer to FIG. 7 hereinafter for a description of the air pressure flow portion of the control system 26.

Now, to begin movement of the carriage assembly 40 in the reverse direction, the operator closes reverse switch 270 on the control panel 26. Power is supplied directly to relay 272 which controls the time delay circuit 274. Contact 272*a* is normally closed and connects the capacitive discharge relay to the power source. Contact 272*a* normally passes a signal through resistor R1 which charges capacitor C. When relay 272 is energized, contact 272*a* is opened and contact 272*b* in series with resistor R2 closes and the voltage on capacitor C prevents the time delay relay from operating. As the capacitor C slowly discharges the stored voltage will fall below a minimum and relay TDR will de-energize. The normally closed reverse relay contact 276*a* conducts power through solenoid 278 which controls the up motion of the doctor blade 206, shown in FIG. 5. Therefore, any time the carriage assembly 40 is placed in the reverse direction, the doctor blade 200 is raised before motion begins. Time delay relay contact TDR(*a*) is held open until the voltage on capacitor C falls below a minimum level allowing relay TDR to operate. After time delay relay contact TDR(*a*) closes, reverse relay 280 closes. The closure of reverse relay reverses the field to the universal motor 260 in a manner well-known in the art causing the motor to drive carriage assembly 40 toward the closed end of press 10. As more fully described hereinafter, the cleaning function begins to operate and removes any foreign particles on the plate 34. However, it should be apparent that the cleaning unit can be immobilized during the preliminary return stroke if desired.

As the carriage 40 approaches the closed end of the press, microswitch 288 is closed which through relay 290 places a uniform voltage across the motor 260 as described above. In this manner, regardless of the speed of the carriage set by a variable control of the motor after the carriage assembly has passed over the plate 34, the speed of the carriage is reduced to a constant amount so that breaking and stopping of the carriage uniformity is obtained. As the carriage assembly approaches the closed end of the press 10 microswitch 275 is closed energizing relay 276 and opening contact 276*a* to stop the motor and through dynamic breaking stop the carriage assembly 40.

Now, with the selected ink of a predetermined and measured quantity placed within the receiving cylinder on the return stroke and the paper manually inserted and alligned on print or impression cylinder 42, the press is ready to operate in the accustomed manner. Print-trip switch 250 is opened and the print relay contacts 252*a* and 252*b* are closed. The forward motion switch 254 is closed which provides power to universal motor 260 to drive the carriage forward. Additionally since print relay contact 252*a* is closed, refill prevent relay 282 opens contact 282*a* to prevent inadvertent refilling of one of the cylinders.

The plurality of microswitches 300, 302, 304 and 306 are spaced apart along the frame of the press 10 and are contacted as the carriage assembly 40 moves in the forward direction. Each microswitch 300 through 306 controls one of the solenoid valves 308*a* through 308*d*. As the microswitch 300 is closed, solenoid 308*a* is energized and since selector switch 284*a* has been closed by the press operator, the ink will be released by the rotation of retaining cylinder 78*a* along the edge of the plate 34. It should be noted that since the block 52 has spaced apart retaining cylinders 78*a* through 78*d*, a corresponding adjustment in the placement of the microswitches 300, 302, 304 and 306 along the frame of the press 10 is necessary so that the ink is dispensed at the same location without regard to which cylinder is dispensing.

As the carriage moves along the press frame in the forward direction, microswitch 292 is closed which energizes latching relay 294 closing relay contacts 294*a* and 294*b*. Relay contact 294*b* energizes the solenoid valve 296 placing doctor blade 200 in the down position and relay contact 294*a* retains relay 294 energized and the blade 200 in the down position after microswitch 292 is released.

Now, as the ink is dispensed and the doctor blade 206 uniformly spreads the ink across the plate 34, the cylinder 42 carrying the paper will press the paper upon the printing plate 34 so that the ink retained in the wells or grooves of the plate 34 will be absorbed by the paper forming the first printing step in a multicolor proof process. The microswitch 262 is again operated by the carriage and the speed uniformly reduced as described above. Microswitch 255 is similarly operated stopping the carriage assembly.

The carriage assembly 40 must now be returned to the closed end of the press 10 to complete the printing cycle and during this return travel the plate 34 is automatically cleaned by removing the dried or excess ink present from the immediately preceding printing process. In addition, the operator selects the next color of ink from the reservoirs by closing one of the selector switch contacts 284*a* through 284*d*. The newly selected ink is transferred to the appropriate receiving cylinder as explained hereinabove. The print switch 250 remains open and the reverse switch 270 is closed supplying power through relay 272 and begins operation of time delay circuit 274 as described above. Solenoid valve 278 raises the doctor blade 206 out of contact with the press bed. After a predetermined amount of time has passed, the time delay relay contact TDR(*a*) closes supplying power through relay 280 to the motor 260 causing the carriage assembly 40 to begin movement in the return direction.

Since the print-trip switch 250 is opened, the print contacts 252*a* and 252*b* are closed, the power is supplied to solenoid valve 314 to begin the spray solvent application across the plate 34. The power is also supplied to the brush motor 316 to begin the rotation of the brushes and finally, closes relay 318 of the vacuum unit to begin the suction removal of solvent and loosened ink. As an alternative, the vacuum unit could always be in operation which would result in a minimal amount of cleaning upon each pass. As the carriage 40 moves the microswitch 310 is operated, the wash stop relay 312 is energized and remains closed through relay contact 312*a* after the microswitch 310 is released which stops the wash cycle by opening contact 312*b*. This reduces the unnecessary dispensing of solvent across the entire surface of the press bed and limits the application of the liquid only to the surface of the plate 34. The microswitch 310 is located on the press frame just after the plate 34. The carriage again slows down and stops as explained above as it approaches the closed end of the press 10 and contacts microswitches 288 and 276. The printing cycle is complete. If the same color of ink has been selected by the operator a new sheet of paper is aligned and the printing process repeated to produce another proof sheet of the same color. If another color of ink has been selected by the operator, a different printing plate 34 is registered on the press bed and the printing is repeated.

FIG. 7 is an air pressure diagram and corresponds to the previous description of the press operation. Compressor 38 provides a source of air to the components via standard tubes or hoses. It should be apparent that the press could operate with another type of pressure source instead of air pressure.

The solenoid valves 308*a* through 308*d* are connected to actuators 96*a* through 96*d* by hoses or other well-known means. If the solenoid of 308*a* is energized as described with reference to FIG. 6, the valve of 308*a* opens and passes the air pressure on line 330 to actuator 96*a*. The actuator 96*a* is connected to retaining cylinder 78*a* and when actuator 96*a* receives air pressure it rotates cylinder 78*a* as pictorially shown in FIG. 7.

The air pressure on line 330 is regulated by manual valve 332 or a similar well-known device to any desired pressure as indicated by gauge 334. The regulated air pressure is applied to solvent tank 336. If the solenoid of 314 is energized as described with reference to FIG. 6, the valve of 314 opens and passes the air pressure through a standard manifold 338, well-known in the art, to the applicators 121.

Compressor 38 also supplies air pressure over line 330 through manual valve 340 and associated gauge 342 to solenoid valves 286*a* through 286*d*. If the solenoid of 286*a* is energized as described in FIG. 6, the valve of 286*a* opens and passes air pressure to reservoir 56*a*. The pressure supplied to reservoir 56*a* transfers the ink contained within reservoir 56*a* through transfer device 84*a* and conduit 82*a* in face plate 72 to the groove 80*a* of retaining cylinder 78*a* as described in FIGS. 2 and 3.

Compressor 38 also provides air pressure over line 330 and manual control valve 344 and associated gauge 346. The dual action solenoid valve 348 represents the joint operation of solenoid valves 296 and 278 as described in FIG. 6. If the solenoid of 296 closes air pressure is passed by the valve of 296 as shown on line 186 of FIG. 5 to the manifold 350. The air pressure forces the cylinder 180 to bring the doctor blade 200 to the down position and the cleaning unit 120 to the up position. The cylinder 180*a* merely represents the companion cylinder to cylinder 180 on the opposite side of press 10 and operates in conjunction therewith. If solenoid of valve 278 energizes the valve of 278 opens and passes air on line 188 of FIG. 5. The air pressure causes the reverse operation of cylinder 180 as described hereinabove raising doctor blade 200 and lowering cleaning unit 120. Thus, the air pressure system operates in conjunction with the electrical system described in FIG. 6 to control the operation of the press and eliminate the unreliability of manual press operation.

It is to be understood that the present disclosure can be modified or varied by applying current knowledge without departing from the spirit and scope of the novel concepts of the invention.

We claim:

1. A gravure press for making proofs using a printing plate comprising:

a press bed for holding said printing plate;

a control system for regulating the operation of said press; and, a carriage assembly responsive to said control for moving relative to said plate and including:

an ink distribution system responsive to said control for dispensing a predetermined quantity of ink upon said plate and comprising:

a plurality of reservoirs for containing ink;

a plurality of retaining cylinders each having a longitudinal receiving channel recessed from the surface for temporarily holding ink;

a housing holding said retaining cylinders for rotational movement about the axis of said cylinder;

a plurality of transfer devices each connected to one of said reservoirs and one of said retaining cylinders and responsive to said control for filling said channel of one of said retaining cylinders with ink; and, a plurality of actuators each connected to one of said cylinders for rotating said cylinder to dispense ink;

spreading means responsive to said control for uniformly moving said dispensed ink across said plate; and, a cleaning unit responsive to said control for removing said dispensed ink after printing.

2. A gravure press as set forth in claim 1 wherein said cleaning unit comprises:

an applicator for depositing solvent upon said plate;

a rotating brush assembly for loosening dried ink on said plate; and, a vacuum assembly for removing said solvent and loosened ink from said plate.

3. A gravure press as set forth in claim 2 wherein said rotating brush assembly includes:

two spaced apart brushes extending transversely across the width of said plate; and, a gear drive responsive to said control for rotating said brushes in opposing direction.

4. A gravure press as set forth in claim 3 wherein said vacuum assembly extends transversely across the width of said plate and is positioned between said spaced brushes.

5. A gravure press as set forth in claim 1 wherein said spreading means comprises a doctor blade.

* * * * *